US005963229A

United States Patent [19]

Fukuoka

[11] Patent Number: 5,963,229

[45] Date of Patent: Oct. 5, 1999

[54] INK JET RECORDING APPARATUS HAVING INK ABSORBING MEMBER FOR ABSORBING INK FROM AN INK WIPING MEMBER

[75] Inventor: Mutsuo Fukuoka, Ama-gun, Japan

[73] Assignee: Brother Kogyo Kabushiki Kaisha, Nagoya, Japan

[21] Appl. No.: 08/694,611

[22] Filed: Aug. 13, 1996

[30] Foreign Application Priority Data

Aug. 24, 1995 [JP] Japan ..... 7-240709

[51] Int. Cl.[6] ..... B41J 2/165

[52] U.S. Cl. ..... 347/33; 347/31

[58] Field of Search ..... 347/22, 33, 31, 347/32

[56] References Cited

U.S. PATENT DOCUMENTS

| | | | |
|---|---|---|---|
| 4,935,753 | 6/1990 | Lehnmann et al. | 347/33 |
| 5,081,472 | 1/1992 | Fisher | 347/31 |
| 5,182,582 | 1/1993 | Okamura | 347/31 |
| 5,357,275 | 10/1994 | Ikado et al. | 347/31 |
| 5,444,474 | 8/1995 | Ohtsubo et al. | 347/33 |

FOREIGN PATENT DOCUMENTS

| | | | |
|---|---|---|---|
| 59-14962 | 1/1984 | Japan | 347/33 |

*Primary Examiner*—N. Le
*Assistant Examiner*—Thien Tran
*Attorney, Agent, or Firm*—Oliff & Berridge, PLC

[57] ABSTRACT

An ink jet recording apparatus includes an ink jet head, a wiper blade for wiping a nozzle plane of the ink jet head and an ink absorbing member in coupled movement with the wiper blade for absorbing and removing the ink adhered to the wiper blade. The wiper blade wipes the ink jet head over a first overlap width. A second overlap width over which the wiper blade and the ink absorbing member contact is made larger than the first overlap width over which the wiper blade and the ink jet head contact. Therefore, the ink absorbing member comes into full contact with the wiper blade such that the ink is completely absorbed and removed by the ink absorbing member.

20 Claims, 8 Drawing Sheets

INK JET RECORDING APPARATUS HAVING INK ABSORBING MEMBER FOR ABSORBING INK FROM AN INK WIPING MEMBER

BACKGROUND OF THE INVENTION

1. Field of the Invention

The present invention relates to an ink jet recording apparatus and more particularly to an ink jet recording apparatus having a wiping device for improving ink jetting condition of an ink jet head by wiping surplus ink remaining on an ink jetting plane of the ink jet head.

2. Description of Related Art

In general, printing operation is conducted in the ink jet recording apparatus by ejecting ink droplets from a nozzle plane of an ink jet head on a recording medium such as a print sheet. At this time of printing operation, the ink is left on the nozzle plane and if the ink is left alone directions of the ink droplets are deviated from the correct directions due to the remaining ink, thereby recording result is disturbed. In this way, in case that the surplus ink is left on the nozzle plane of the ink jet head, the ink jetting condition becomes inferior.

Therefore, in order to remove the remaining ink and recover the ink jetting condition normal, it is necessary to periodically clean the nozzle plane of the ink jet head. For this purpose, it is usual in the ink jet recording apparatus that it is installed out of recording area by the ink jet head a wiping mechanism in which the remaining ink on the nozzle plane is wiped and removed by a resilient wiper blade. Further, cleaning of the nozzle plane is periodically conducted by moving the ink jet head to a position opposite to the wiping mechanism.

By the way, after the wiping operation of the nozzle plane is conducted, the wiped ink is left on the wiper blade. If this condition (that is, the condition where the wiped ink is left on the wiper blade) is neglected as it is, it is possible that the wiped ink is reversely adhered to the ink jet head at the time of the next wiping operation, thereby it is conceivable that cleaning of the nozzle plane cannot be sufficiently done. To dissolve this problem, it is necessary to clean the wiper blade itself every wiping operation is conducted and to keep the clean condition for the next wiping operation.

Thus, in the ink jet recording apparatus, it is constructed so that an absorbing member made of urethane foam with good ink absorbing ability is arranged in the wiping mechanism and the wiped ink on the wiper blade is absorbed through the absorbing member by contacting the wiper blade with the absorbing member after the wiping operation, thereby the wiper blade is cleaned.

Here, the conventional wiping mechanism will be described according to FIG. 8. In FIG. 8, arrangement of the conventional absorbing member in the ink jet recording apparatus is disclosed. In FIG. 8, an absorbing member 74 is mounted on a carriage 72 in which an ink jet head 71 is installed. On the other hand, a wiper blade 75 is arranged at a side face of a holder 76 and is able to move in a direction indicated by an arrow U with the holder 76. When the carriage 72 is moved to recording area from non-recording area along a direction indicated by an arrow T, the holder 76 is moved ahead and a top of the wiper blade 75 is slightly projected in a moving plane of the nozzle of the ink jet head 71. In this state, if the carriage 72 is moved in the direction of the arrow T, the ink jet head 71 is first contacted with the wiper blade 75, thereby wiping operation is conducted, and thereafter the absorbing member 74 is contacted with the wiper blade 74, thereby cleaning of the wiper blade 75 is finished.

However, it is not always sufficient the above cleaning operation of the wiper blade 75 conducted by the absorbing member 74 in the conventional ink jet recording apparatus.

The reason is due to a relation existing between a first overlap width of the wiper blade 75 and the ink jet head 71 and a second overlap width of the wiper blade 75 and the absorbing member. That is to say, as shown in FIG. 9, in the conventional ink jet recording apparatus, the first overlap width A between the wiper blade 75 and the ink jet head 71 is wider than the second overlap width B between the wiper blade 75 and the absorbing member 74. Thus, it concludes that the ink remaining area of the wiper blade 75 where the wiped ink from the ink jet head 71 is left is not completely contacted with the absorbing member 74. Therefore, a part of the ink on the wiper blade 75 is left thereon without being absorbed by the absorbing member 74. In this way, since the next wiping operation is done while the ink is left on the wiper blade 75, cleaning of the ink jet head 71 cannot be sufficiently conducted by wiping operation.

Further, in case that the absorbing member 74 is mounted on the carriage 72 as shown in FIG. 8, the second overlap width B inevitably becomes narrower than the first overlap width A. Because, in order to avoid that the recording medium is contaminated by the absorbing member 74 which contacts with the recording medium while recording operation is done, it is necessary to inevitably mount the absorbing member 74 on the carriage 72 so that the top of the absorbing member 74 is slightly retracted from the nozzle plane of the ink jet head 71. Here, it is conceivable that the second overlap width B is made wider than the first overlap width A by moving more ahead the holder 76 when the wiper blade 75 contacts with the absorbing member 74, in comparison with a case that the wiper blade 74 contacts with the ink jet head 71. But, in this case, it will not be real since the mechanism for moving the holder 76 forward and backward and control thereof become very complicated.

Further, there exists an ink jet recording apparatus that the absorbing member is mounted on the main frame of the apparatus without mounting it on the carriage. But, the above first and the second overlap widths A and B are not considered in such ink jet recording apparatus.

SUMMARY OF THE INVENTION

In order to overcome the above problems, the present invention provides an ink jet recording apparatus with a wiping device in which an overlap width between a wiper blade and an absorbing member when the wiper blade contacts with the absorbing member is made wider than an overlap width between the wiper blade and an ink jet head when the wiper blade contacts with the ink jet head, thereby ink left on the wiper blade can be certainly removed from the wiper blade by the absorbing member and the ink jet head can be always wiped by the clean wiper blade, as a result, it can maintain a good jetting condition of the ink jet head.

In order to accomplish the above object, the present invention provides an ink jet recording apparatus including an ink jet head for ejecting ink droplets onto a recording medium, a wiping member for wiping a nozzle plane of the ink jet head so as to remove surplus ink on the nozzle plane and recover ink jetting condition of the ink jet head and an ink absorbing member for absorbing the ink adhered to the wiping member;

wherein the wiping member contacts with the ink jet head with a first overlap width and the wiping member contacts with the ink absorbing member with a second overlap width, and wherein the second overlap width is made larger than the first overlap width.

According to the ink jet recording apparatus of the present invention, when the surplus ink is adhered on the nozzle plane of the ink jet head, the wiping member contacts with the ink jet head with the first overlap width and wipes the nozzle plane, thereby the surplus ink is removed from the nozzle plane and the jetting condition of the ink jet head is recovered. At that time, the wiped surplus ink from the nozzle plane is adhered to the area of the wiping member which contacts with the ink jet head. Thereafter, the area of the wiping member which wipes the ink jet head contacts with the ink absorbing member with the second overlap width larger than the first overlap width. Thereby, it concludes that the area of the wiping member to which the wiped ink is adhered is completely contacted with the ink absorbing member. As a result, the ink adhered to the wiping member is completely absorbed by the ink absorbing member and is never left on the wiping member. Therefore, wiping operation of the nozzle plane by the wiping member is always conducted by the clean wiping member.

As mentioned, according to the present invention, since the second overlap width with which the wiping member and the ink absorbing member mutually contact is made larger than the first overlap width with which the wiping member and the ink jet head mutually contact, the ink on the wiping member after wiping can be certainly absorbed and removed by the ink absorbing member. Therefore, the ink jet head can be always wiped by the clean wiping member and thus good jetting condition of the ink jet head can be maintained.

The above and further objects and novel features of the invention will more fully appear from the following detailed description when the same is read in connection with the accompanying drawings. It is to be expressly understood, however, that the drawings are for purpose of illustration only and not intended as a definition of the limits of the invention.

BRIEF DESCRIPTION OF THE DRAWINGS

The ink jet recording apparatus according to the present invention will be described with reference to the following drawings wherein.

DETAILED DESCRIPTION OF THE PREFERRED EMBODIMENTS

A detailed description of the preferred embodiments of the ink jet recording apparatus embodying the present invention will now be given with reference to the accompanying drawings.

Figure 1:
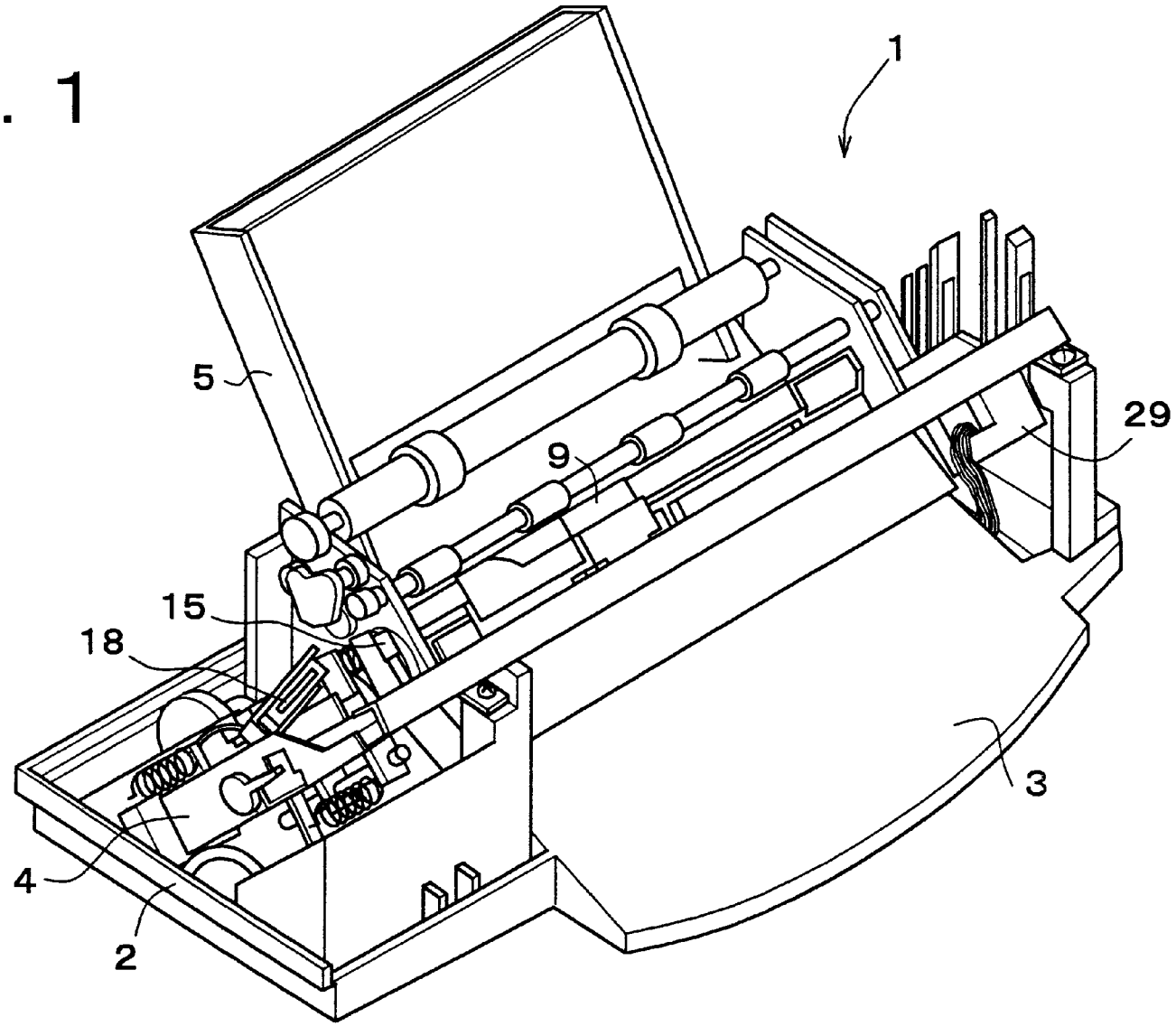
FIG. 1 is a perspective view of the ink jet recording apparatus according to the first embodiment of the present invention.

At first, the ink jet printer according to the first embodiment will be described. In the ink jet printer 1 shown in FIG. 1, it is arranged in front of a main frame 2 a manual sheet supply part 3 through which print sheets are manually supplied. At rear side of the manual sheet supply part 3, it is arranged at upper position of the main frame 2 a sub-frame 4 in which a carriage 9 having an ink jet head 10, a wiper blade 15 (see FIG. 2) and a purging mechanism 18 are installed. At an upper rear position of the sub-frame 4, a sheet supply cassette 5 for stacking plural print sheets is releasably mounted. And a CR motor 29 for reciprocally moving the carriage 9 along with the print sheet is arranged under the sub-frame 4 at the right front position.

The wiper blade 15 wipes an ink orifice plane (nozzle plane) of the ink jet head 10 and removes surplus ink on the nozzle plane. The wiper blade 15 is made of resilient material without ink absorbing ability. The purging mechanism 18 acts for sucking and removing the degraded ink in the ink jet head 10 by producing negative pressure. The above wiper blade 15 and the purging mechanism 18 are arranged to recover the ink jetting condition of the ink jet head 10 when such condition becomes poor. And in the sub-frame 4, a platen roller 6 (mentioned later) for sending the print sheet is arranged.

Figure 2:
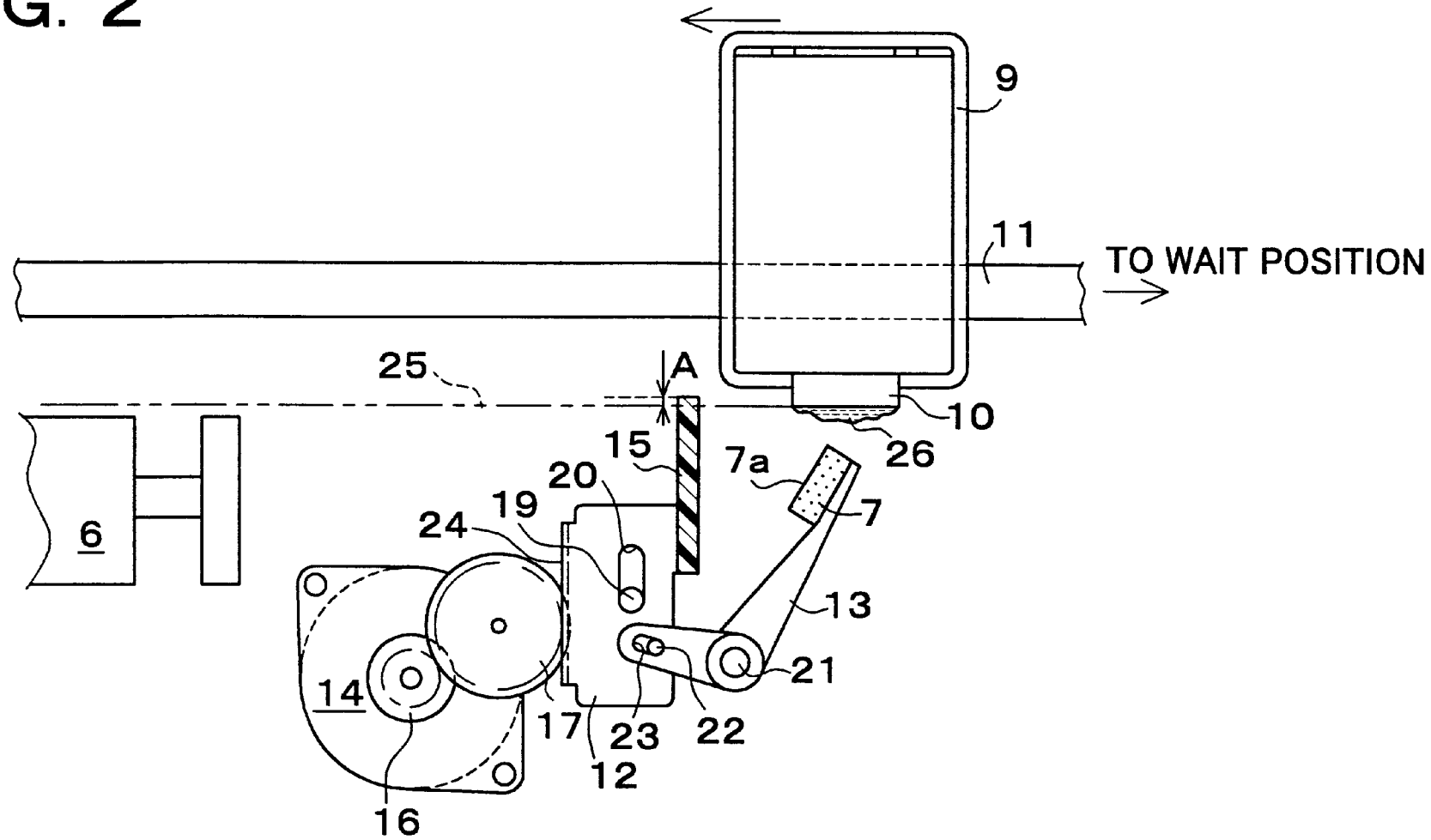
FIG. 2 is a plan view showing a state that a wiper blade is projected toward a moving plane of an ink jet head and an absorbing member is distant from the wiper blade.
Figure 3:
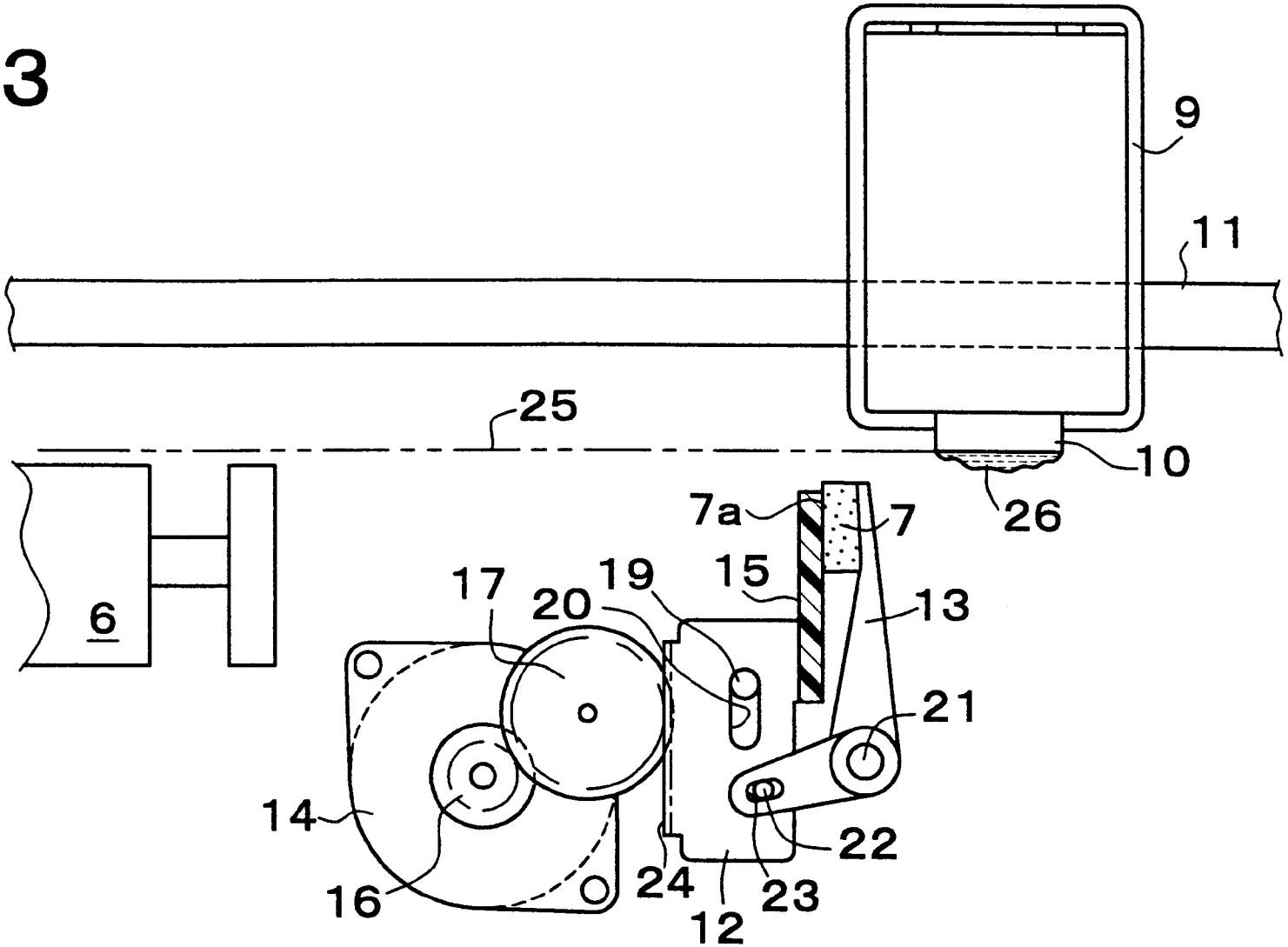
FIG. 3 is a plan view showing a state that the wiper blade is retracted from the moving plane of the ink jet head.

In FIGS. 2 and 3, the ink jet head 10 is installed on the carriage 9 and the carriage 9 is able to reciprocally move along a carriage shaft 11 by being driven through the CR motor 29. Here, the ink jet head 10 conducts printing on the print sheet by ejecting ink droplets from the ink orifices on the nozzle plane. And numeral 26 indicates surplus ink left on the nozzle plane of the ink jet head 10. Moving plane 25 of the ink jet head 10 produced when the carriage 9 is moved is indicated by alternate long and two short dashes line. The carriage shaft 11 is arranged in the sub-frame 4 parallel to the platen roller 6 for sending the print sheet. When the carriage 9 is positioned in a range that it opposes to the platen roller 6, printing operation can be done on the print sheet supported on the platen roller 6 by the ink jet head 10.

Here, it is made a wait position of the carriage 9 at the right side out of the area shown in FIGS. 2 and 3. At the wait position, the carriage 9 is waited while waiting until printing command is transmitted to the ink jet printer 1 or until the print sheet is sent to and discharged from the platen roller 6. And also, at the wait position, the ink jet head 10 is covered by the purging mechanism 18 and the degraded ink in the ink jet head 10 is sucked and removed by negative pressure produced though the purging mechanism 18.

The wiper blade 15 is mounted at a side of a wiper holder 12 which is movable forward and backward (in FIG. 2, upper and lower directions). In the wiper holder 12, it is formed a long hole 20 in which a projection 19 fixed on the sub-frame 4 is movably inserted. Based on that the projection 19 is contacted with the front end and the rear end of the long hole 20, both the forwarded position and the retracted position of the wiper holder 12 are limited. And at the opposite side of the wiper holder 12 to the wiper blade 15, a rack 24 is formed. And it is formed on the wiper holder 12 a projection 22 which is utilized for rotating an arm 13 (mentioned later). Further, a drive motor 14 is arranged so as to move the wiper holder 12 forward and backward. Here, the wiper holder 12 is constructed to move forward and backward based on that rotation of the drive motor 14 is transmitted to the rack 24 through a motor gear 16, a idle gear 17.

FIG. 2 indicates a state where the wiper holder 12 is moved forward, and in this state, the top of the wiper blade 15 is projected in the moving plane 25 of the ink jet head 10. At this time, a projecting length A of the wiper blade 15 is called as a first overlap width. And FIG. 3 indicates a state where the wiper holder 12 is retracted backward, and in this state, the top of the wiper blade 15 is retracted from the moving plane 25 of the ink jet head 10. The wiper holder 12 is usually retained to the retracted position and is moved forward as shown in FIG. 2 only when wiping operation (mentioned later) is conducted. The reason that the wiper holder 12 is moved forward and backward as mentioned is as follow. That is, since non-wet coat treatment is done on the nozzle plane of the ink jet head 10, it is necessary to minimize time of the wiping operation taking into consideration durability of the non-wet coat.

The arm 13 is arranged near the wiper holder 12. At one end of the arm 13, an ink absorbing member 7 made of porous material such as urethane foam is adhered. The arm 13 is made rotatable around an arm shaft 21 which is fixed on the sub-frame 4. And hole 23 is formed at an end opposite to the end where the ink absorbing member 7 is adhered, and further the projection 22 on the wiper holder 12 is inserted in the hole 23. Therefore, corresponding to that the wiper holder 12 is moved forward and backward, the arm 13 is rotated. The ink absorbing member 7 acts for absorbing and removing the surplus ink 26 on the wiper blade 15, thereby cleans the wiper blade 15. For this purpose, the ink absorbing member 7 has a contact plane 7*a* which contacts with the wiper blade 15.

When the wiper holder 12 is moved forward, the arm 13 is rotated in the anticlockwise direction, thus the ink absorbing member 7 is separated from the wiper blade 15, as shown in FIG. 2. On the other hand, when the wiper holder 12 is retracted, the arm 13 is rotated in the clockwise direction, thus the ink absorbing member 7 is contacted with the wiper blade 15, as shown in FIG. 3. At this time, the ink absorbing member 7 approaches to the wiper blade 15 from the opposite side to the platen roller 6, thereafter it concludes that the contact plane 7*a* thereof contacts with the wiper blade 15. And under the condition that the ink absorbing member 7 contacts with the wiper blade 15, the top of the ink absorbing member 7 is slightly projected from the top of the wiper blade 15. Therefore, in such state, it concludes that the top portion of the wiper blade 15 existing a side opposite to the platen roller 6 is fully covered by the ink absorbing member 7. Here, the retraction amount and the shape of the arm 13 is determined so that the wiper blade 15 is not largely deformed by being strongly depressed through the ink absorbing member 7. And a contacting length B between the wiper blade 15 and the ink absorbing member 7 is called as a second overlap width. In the ink jet printer 1 of the present invention, the forward and backward moving amount of the wiper holder 12, the position and the shape of the ink absorbing member 7 are determined so that the second overlap width B becomes larger than the first overlap width A shown in FIG. 2.

Next, operation of the ink jet printer 1 will be described hereinafter. In the ink jet printer 1, while the print sheet is forwarded to the platen roller 6 from the sheet supply cassette 5 or the manual sheet supply part 3, the carriage 9 and the ink jet head 10 is controlled according to commands from a personal computer, thereby printing of characters, symbols or figures is conducted. When such printing is conducted, the print sheet is fed by the platen roller 6 and is stopped at a position that a line to be printed opposes to the ink jet head 10. Further, the carriage 9 is driven with a predetermined printing rate at a position where the carriage 9 opposes to the platen roller 6. During the carriage 9 is driven, the ink jet head 10 ejects ink droplets onto the print sheet according to printing command, thereby printing is done.

At the time of printing, it will be possible that the surplus ink 26 is left on the nozzle plane of the ink jet head 10, thereby the jetting condition of the ink jet head 10 becomes inferior. Thus, in the ink jet printer 1, the nozzle plane of the ink jet head 10 is periodically wiped by the wiper blade 15. And further, the wiped surplus ink 26 is removed and cleaned from the wiper blade 15, since the wiped surplus ink 26 is reversely shifted to the ink jet head 10 at the next wiping operation if the wiped surplus ink 26 on the wiper blade 15 is left alone as it is, as a result, the ink jetting condition of the ink jet head 10 becomes insufficient. The wiping operation and the cleaning operation will be described hereinafter.

The wiping operation is necessary if the surplus ink 26 is adhered on the nozzle plane of the ink jet head 10 and the ink jetting condition becomes inferior. In such case, the carriage 9 is moved to the right direction in FIG. 3 from the position opposing to the platen roller 6. At this time, as shown in FIG. 3, the wiper holder 12 is retracted and the wiper blade 15 is also retracted, thus the wiper blade 15 does not contact with the ink jet head 10. Further, the carriage 9 is moved to the wait position over a position where the carriage 9 opposes to the wiper blade 15, and is stopped at the wait position.

Figure 4:
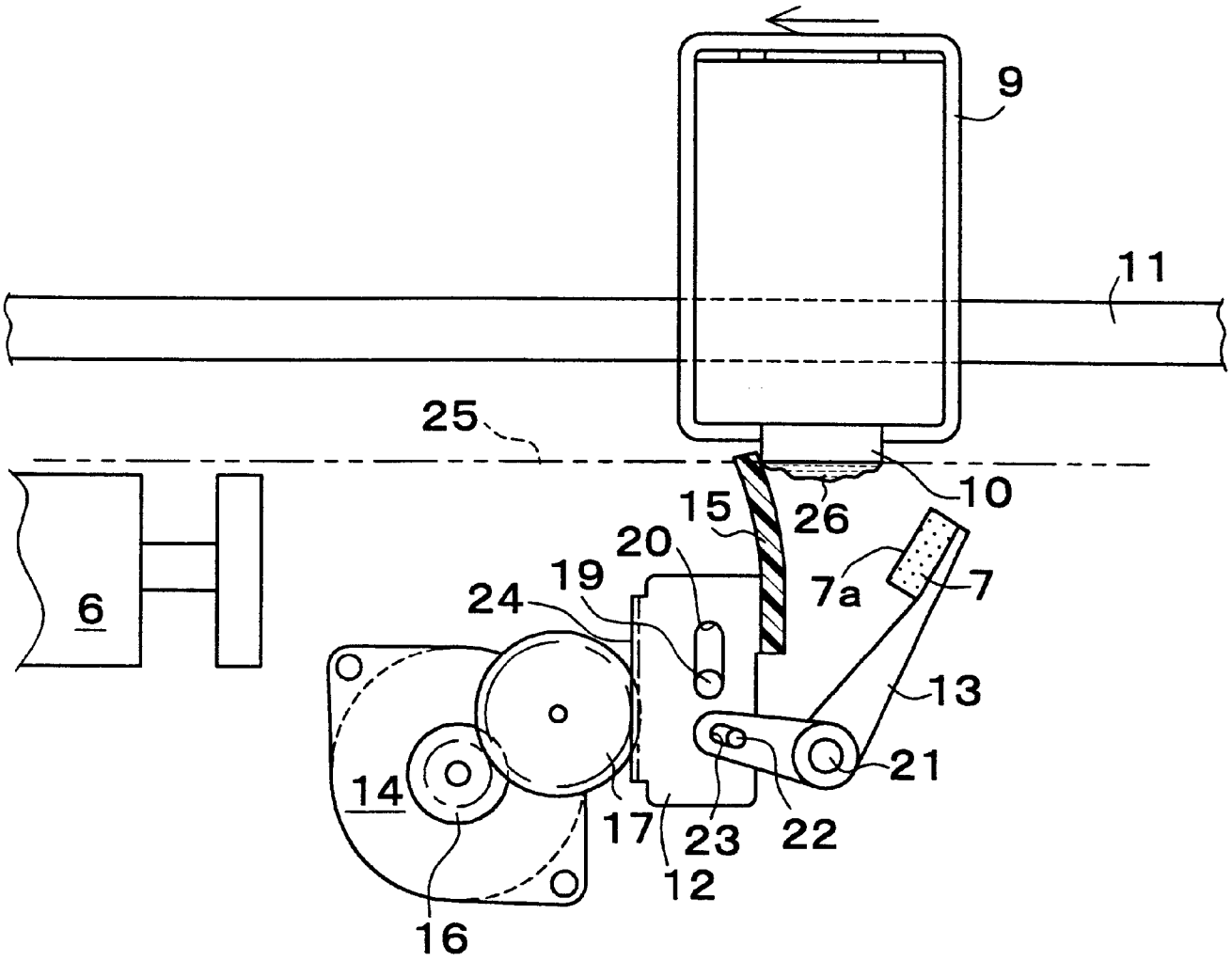
FIG. 4 is a plan view showing a state that the wiper blade is wiping the ink jet head while moving a carriage.

The wiper holder 12 is moved forward by the drive motor 14 and is set to the state shown in FIG. 2. Therefore, the top of the wiper blade 15 is projected in the moving plane 25 with the first overlap width A. And when the carriage 9 is moved in a direction indicated by an arrow in FIG. 2, the ink jet head 10 contacts with the wiper blade 15 at the opposite side to the platen roller 6, thus the wiper blade 15 is resiliently bent. This state is shown in FIG. 4. If the carriage 9 is furthermore moved in the arrowed direction, the surplus ink 26 on the ink jet head 10 is wiped by the wiper blade 15, therefore the ink jetting condition of the ink jet head 10 is recovered. At this time, the surplus ink 26 is adhered to the wiper blade 15 at the area of the first overlap width A, such area being positioned at the opposite side to the platen roller 6.

Figure 5:
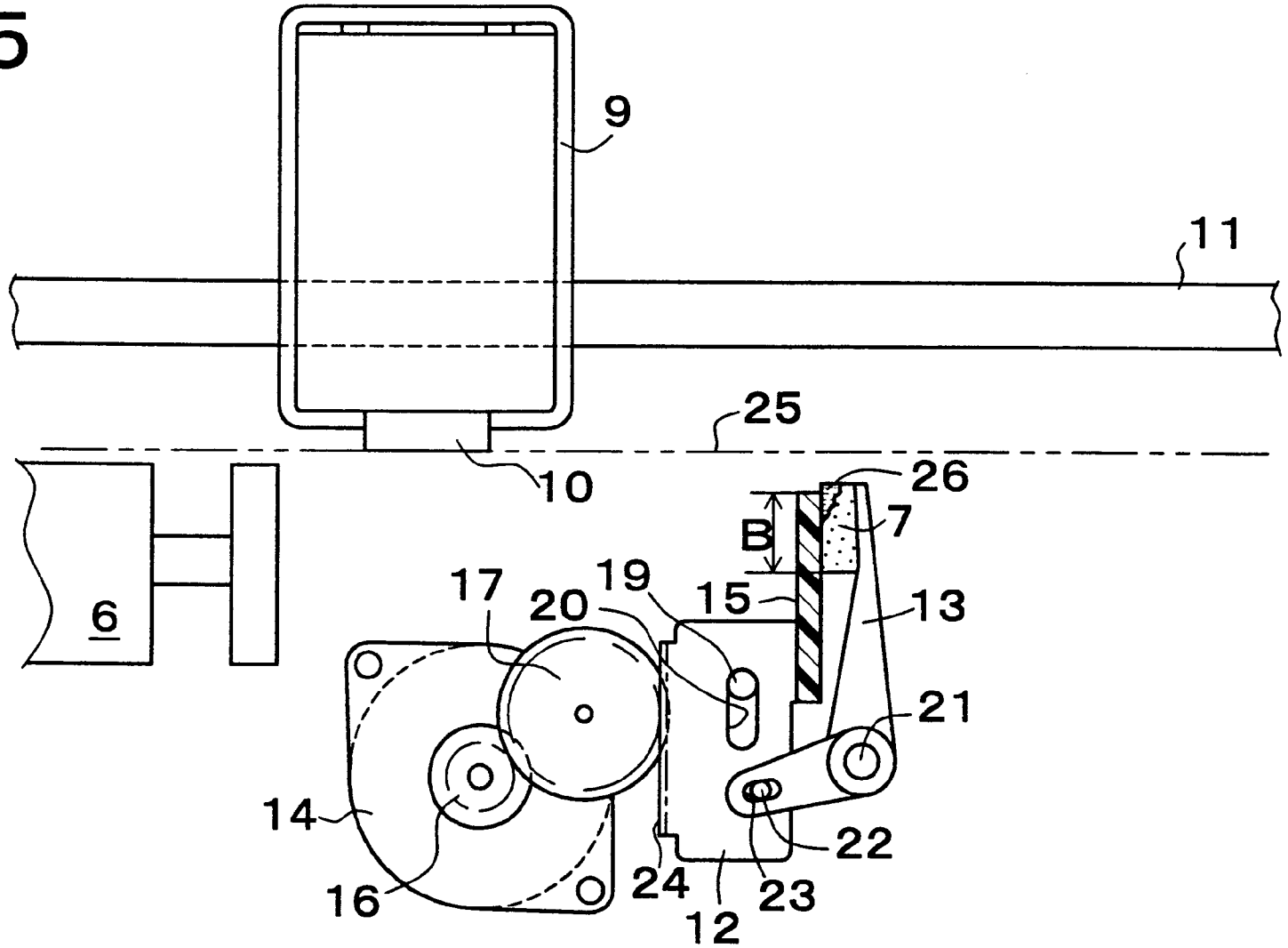
FIG. 5 is a plan view showing a state that the wiper blade is cleaned by the absorbing member.

Thereafter, the carriage 9 is furthermore moved and the ink jet head 10 passes the wiper blade 15, thereby the wiping operation is finished. After the wiping operation, the wiper holder 12 is retracted by the drive motor 14. At that time, the arm 13 is rotated and the contact plane 7*a* of the ink absorbing member 7 is contacted with the wiper blade 15 at the opposite side to the platen roller 6 (that is, the side where the ink jet head 10 contacts during the wiping operation). To this side, the surplus ink 26 is adhered from the ink jet head 10, therefore the surplus ink 26 is absorbed in the ink absorbing member 7. This state is indicated in FIG. 5.

Here, the top of the ink absorbing member 7 is slightly longer than that of the wiper blade 15 and the top portion of the wiper blade 15 by which the surplus ink 26 is wiped is fully covered by the ink absorbing member 7. Further, the second overlap width B between which the wiper blade 15 and the ink absorbing member 7 mutually contact is larger than the first overlap width A. And the surplus ink 26 on the wiper blade 15 is adhered to the area which is positioned in the range of the first overlap width A from the top of the wiper blade 15. Based on the above facts, the area that the surplus ink 26 is adhered to is completely contacted with the ink absorbing member 7, therefore the surplus ink 26 is completely absorbed in the ink absorbing member 7. And since it is kept the ink absorbing member 7 to be continuously contacted with the wiper blade 15 until the next wiping operation is conducted, the surplus ink 26 is completely absorbed in the ink absorbing member 7 for a long absorbing time. As mentioned, the cleaning operation of the wiper blade 15 is done, thus the surplus ink 26 is never left on the wiper blade 15.

Further, during the above wiping operation, the ink absorbing member 7 does not strongly depress and largely deform the wiper blade 15, thus the wiper blade 15 does not rebound even if the wiper holder 12 is moved forward for the next wiping operation and the ink absorbing member 7 is separate from the wiper blade 15.

As mentioned above, in the ink jet printer 1, since the second overlap width B in the wiper blade 15 is made larger than the first overlap width A, the portion of the wiper blade 15 where the wiped surplus ink 26 is adhered, can completely contact with the ink absorbing member 7, therefore the ink on the wiper blade 15 can be completely absorbed in the ink absorbing member 7 and removed from the wiper blade 15.

Next, the ink jet printer according to the second embodiment will be described hereinafter. Here, the ink jet printer of the second embodiment has basically the same construction as the ink jet printer of the first embodiment and has a different construction of both the wiper blade and its peripheral mechanism from the ink jet printer of the first embodiment.

Figure 6:
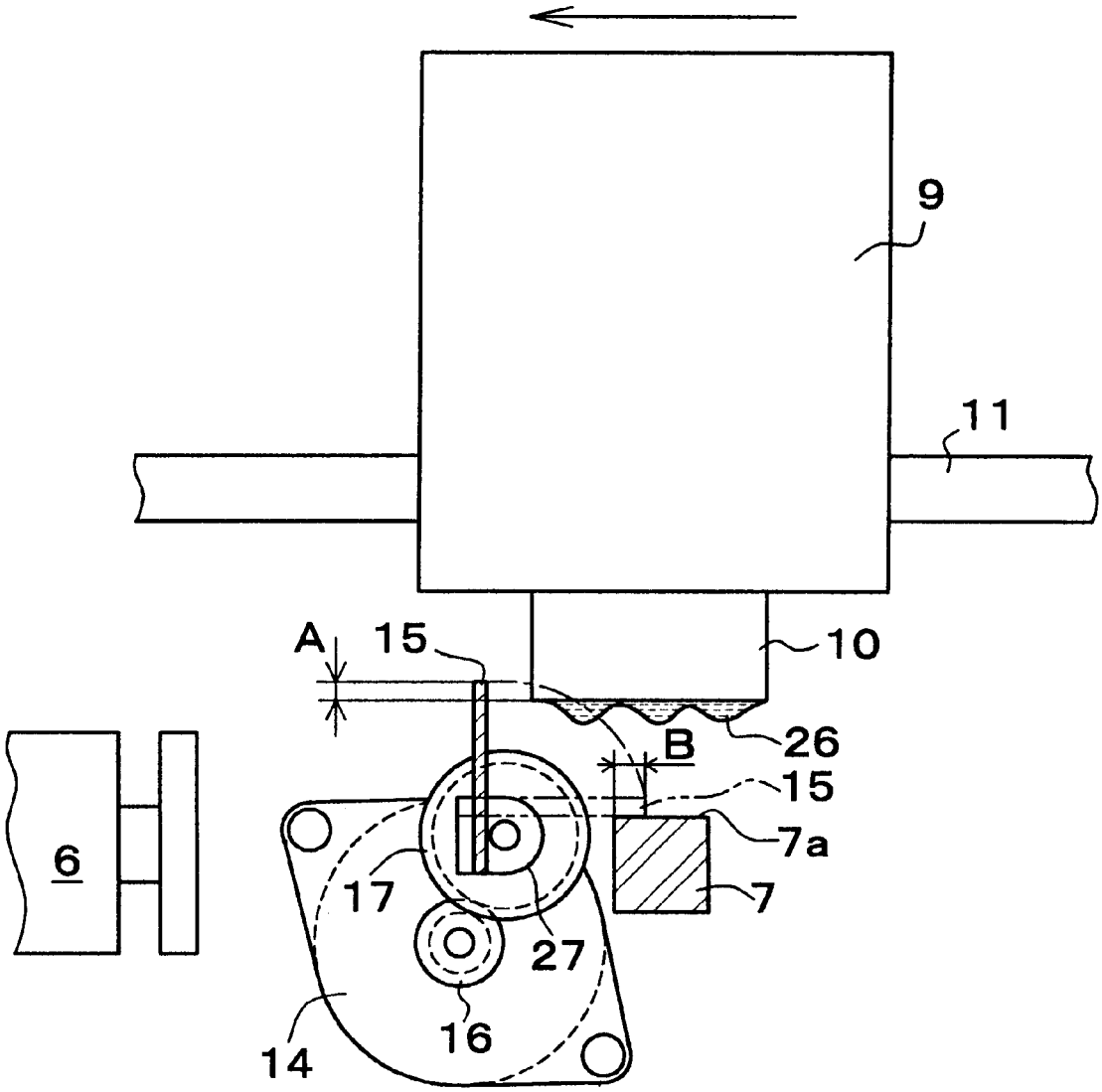
FIG. 6 is a plan view showing a main part of the ink jet recording apparatus according to the second embodiment of the present invention.

In FIG. 6, the carriage 9, the wiper blade 15 and its peripheral construction in the second embodiment are disclosed. In the second embodiment, the wiper blade 15 is mounted on a wiper holder 27 which is rotatable around a supporting shaft. This wiper holder 27 is constructed so as to be rotatable with the wiper blade 15 thereon by being driven the drive motor 14 through the motor gear 16 and the idle gear 17. And the ink absorbing member 7 is fixed to the sub-frame 4. The wiper blade 15 is projected in the moving plane of the ink jet head 10 with the first overlap width A in a state indicated by the solid line, and the wiper blade 15 is contacted with the area defined by the second overlap width B of the ink absorbing member 7 without projecting in the moving plane of the ink jet head 10 when rotated to the state indicated by the alternate long and two short dashes line. Here, similar to the first embodiment, the second overlap width B is larger than the first overlap width A.

In the ink jet printer of the second embodiment, the wiper blade 15 is retained in the state indicated by the alternate long and two short dashes line in FIG. 6 when the wiping operation is not conducted and is contacted with the ink absorbing member 7. Thus, the wiper blade 15 does not contact with the ink jet head 10.

When the wiping operation is done at the time that the surplus ink 26 is adhered on the nozzle plane of the ink jet head 10, the carriage 9 is first moved in the right direction in FIG. 6, thereafter the wiper holder 27 is rotated by the drive motor 14. According to this, the wiper blade 15 is set in the state indicated by the solid line in FIG. 6. At that time, the top of the wiper blade 15 is projected in the moving plane of the ink jet head 10 with the first overlap width A. And when the carriage 9 is moved in the left direction indicated by an arrow in FIG. 6, the ink jet head 10 contacts with the opposite side of the wiper blade 15 to the platen roller 6, thereby the top of the wiper blade 15 is resiliently bent and the wiping operation is conducted.

The wiping operation is finished at the time that the ink jet head 10 passes the wiper blade 15 by moving the carriage 9 furthermore in the left direction. At this time, the wiped surplus ink 26 is adhered to the area corresponding to the first overlap width A, the area being positioned at the opposite side of the wiper blade 15 to the platen roller 6. Thus, the wiper holder 27 is rotated by the drive motor 14 and the wiper blade 15 is set in the the state indicated by the alternate long and two short dashes line in FIG. 6. Thereby, the top portion of the wiping plane in the wiper blade 15 is contacted with the contact plane 7*a* of the ink absorbing member 7. At that time, since the second overlap width B where the wiper blade 15 contacts with the ink absorbing member 7 is larger than the first overlap width A, the wiped ink 26 adhered on the wiper blade 15 is completely absorbed in the ink absorbing member and such ink 26 is not left on the wiper blade 15.

Figure 7:
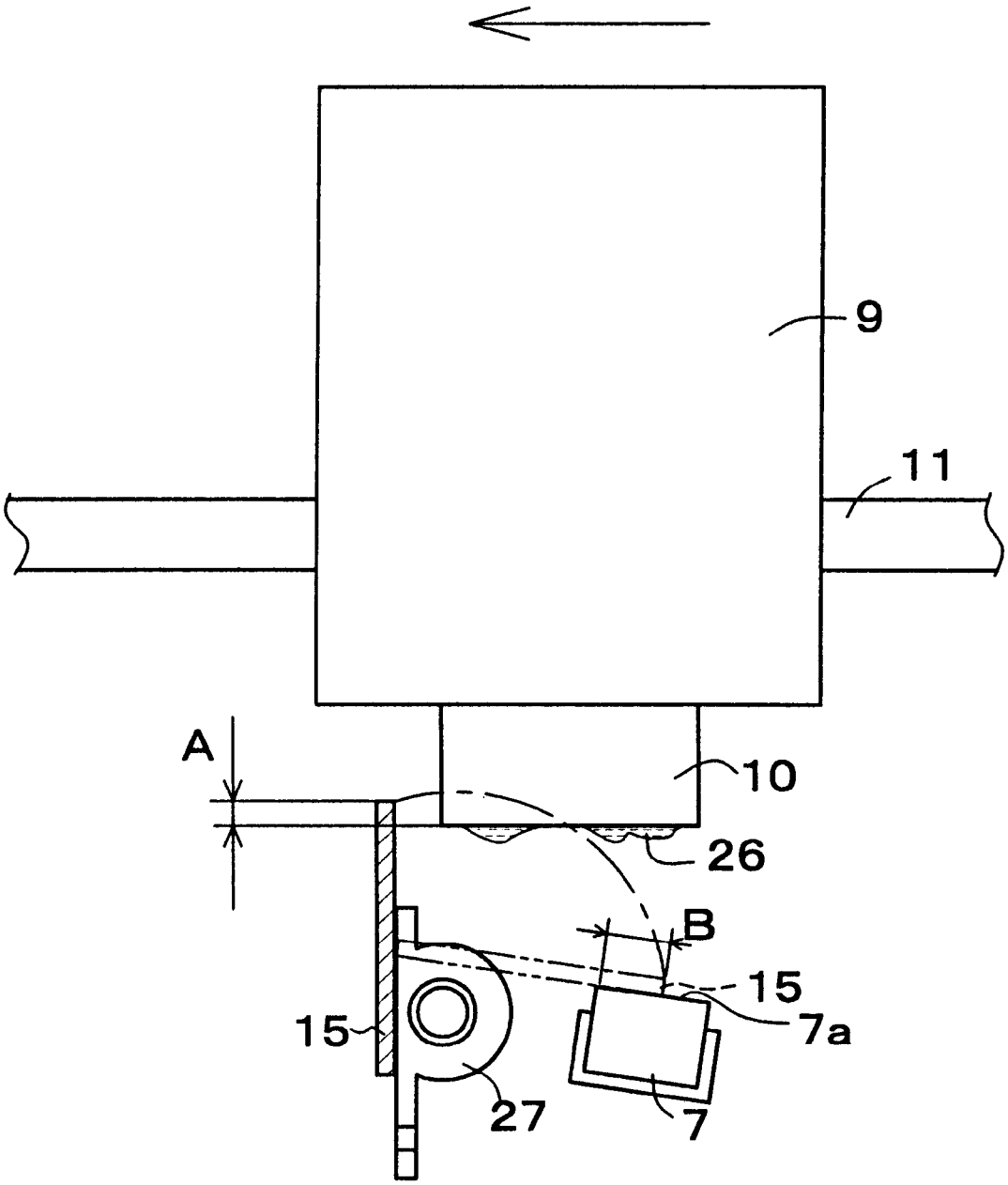
FIG. 7 is a plan view showing a main part of the ink jet recording apparatus according to the modified second embodiment.
Figure 8:
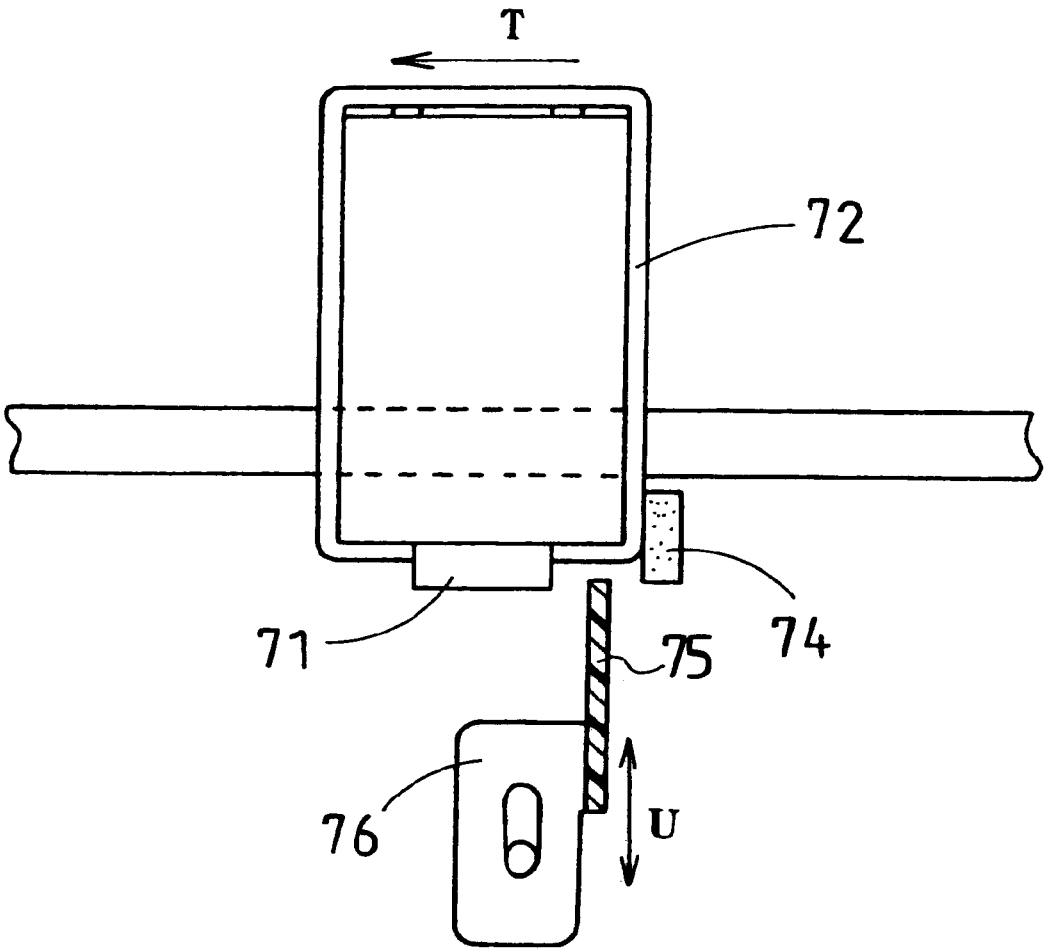
FIG. 8 is a plan view showing the wiping mechanism and peripheral mechanism in the conventional ink jet recording apparatus.
Figure 9:
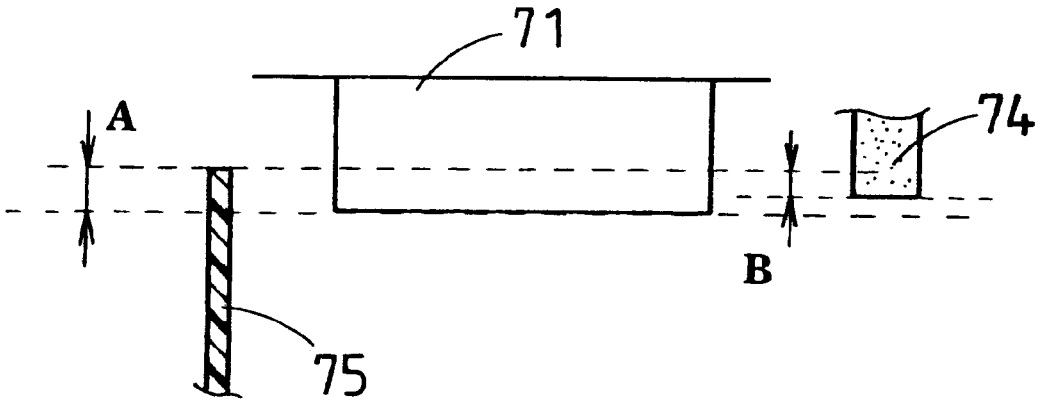
FIG. 9 is a plan view showing a main part of the conventional ink jet recording apparatus in FIG. 8.

Here, in FIG. 6, though the contact plane 7*a* of the ink absorbing member 7 and the moving plane of the ink jet head 10 are arranged parallel each other, the contact plane 7*a* and the moving plane may be arranged without non-parallel relation as shown in FIG. 7.

As mentioned above, in the ink jet printer shown in FIGS. 6 and 7, the second overlap width B in the wiper blade 15 is made larger than the first overlap width A, as in the first embodiment. Therefore, the area of the wiper blade 15 where the wiped ink is adhered by wiping operation can be completely contacted with the ink absorbing member 7, as a result, the ink on the wiper blade 15 can be absorbed in the ink absorbing member 7 and removed.

As mentioned in detail, in the ink jet printer according to the first and the second embodiments, since it is arranged the resilient wiper blade 15 which wipes the nozzle plane of the ink jet head 10 on the basis of movement of the carriage 9, the surplus ink 26 adhered on the nozzle plane of the ink jet head 10 can be wiped and removed by the wiper blade 15 by moving the carriage 9 to the position corresponding to the wiper blade 15, in case that the surplus ink 26 is adhered on the nozzle plane of the ink jet head 10. Thereby, the ink jetting condition of the ink jet head 10 can be recovered. Further, not only the porous ink absorbing member 7 is arranged but also the wiper blade 15 is constructed so as to be able to project and retract against the moving plane of the ink jet head 10, further the wiping area of the wiper blade 15 is contacted with the contact plane 7*a* of the ink absorbing member 7 when the wiper blade 15 is retracted from the moving plane of the ink jet head 10. Therefore, the ink 26 adhered to the wiper blade 15 while wiping of the ink jet head 10 can be absorbed and removed by the ink absorbing member 7, as a result, the wiper blade 15 can be certainly cleaned.

Further, the second overlap width B with which the wiper blade 15 and the ink absorbing member 7 mutually contact is made lager than the first overlap width A with which the wiper blade 15 and the ink jet head 10 mutually contact. Therefore, the area of the wiper blade 15 where the wiped ink 26 is adhered is completely contacted with the ink absorbing member 7, thus the ink is completely absorbed in the ink absorbing member 7 and removed. Thereby, the next wiping operation can be always done by the clean wiper blade 15 to which the ink is not adhered and the wiping of the ink jet head 10 can be stably conducted.

While the invention has been particularly shown and described with reference to preferred embodiments thereof, it will be understood by those skilled in the art that the foregoing and other changes in form and details can be made therein without departing from the spirit and scope of the invention.

For example, instead of the drive motor 14 which is used for driving the wiper holders 12, 27, it is conceivable that a kick mechanism which is actuated by movement of the carriage 9 and the wiper holders 12, 27 are linked to the kick mechanism, thereby the wiper holders 12, 27 are driven by the kick operation of the kick mechanism.

What is claimed is:

1. An ink jet recording apparatus with a frame comprising:

an ink jet head that ejects ink droplets onto a recording medium, the ink jet head being moved and having a moving plane defined by a nozzle plane while moving;

a wiping member that wipes the nozzle plane of the ink jet head so as to remove surplus ink on the nozzle plane and recover ink jetting condition of the ink jet head, the wiping member contacting the ink jet head with a first overlap width and contacting an ink absorbing member with a second overlap width longer than the first overlap width, the ink absorbing member absorbing the ink adhered to the wiping member;

a movable wiper holder that holds the wiper member;

drive means for moving the wiper holder between a first position where the wiping member linearly projects into the moving plane and a second position where the wiping member linearly retracts out of the moving plane and contacts the ink absorbing member; and an arm member having the ink absorbing member thereon, the arm member being moved toward a plane of the wiping member, opposite to a recording place of the ink jet head with respect to the recording medium, corresponding to movement of the wiper holder.

2. The ink jet recording apparatus according to claim 1, wherein the wiping member contacts with the ink jet head with the first overlap width when the wiper holder is moved to the first position and the wiping member contacts with the ink absorbing member with the second overlap width when the wiper holder is moved to the second position.

3. The ink jet recording apparatus according to claim 1, wherein the wiper holder has a long hole with two ends opposite each other, in which a projection formed on the frame is movably inserted, and both the first position and the second position are determined based on contact condition between the projection and the two ends of the long hole.

4. The ink jet recording apparatus according to claim 1, wherein the drive means comprises a drive motor, gears driven by the drive motor and a rack formed in the wiper holder, the rack meshing with one of the gears.

5. The ink jet recording apparatus according to claim 1, wherein the wiping member is a wiper blade made of resilient material without ink absorbing ability.

6. The ink jet recording apparatus according to claim 1, wherein the arm member separates the ink absorbing member from the wiping member when the wiper holder moves to the first position and contacts the ink absorbing member with the wiping member when the wiper holder moves to the second position.

7. The ink jet recording apparatus according to claim 6, wherein the arm member is rotated around a shaft and has a hole in which a projection formed on the wiper holder is engaged, thereby the arm member is rotated corresponding to movement of the wiper holder between a first position where the ink absorbing member separates from the wiping member and a second position where the ink absorbing member contacts with the wiping member.

8. The ink jet recording apparatus according to claim 1, wherein the ink absorbing member is made of porous material.

9. The ink jet recording apparatus according to claim 8, wherein the porous material is urethane foam.

10. An ink jet recording apparatus comprising:

an ink jet head that ejects ink droplets onto a recording medium, the ink jet head being moved and having a moving plane defined by a nozzle plane while moving;

a wiper member that wipes the nozzle plane of the ink jet head so as to remove surplus ink on the nozzle plane and recover ink jetting condition of the ink jet head;

an ink absorber member that absorbs the ink adhered to the wiper member;

a movable wiper holder that holds the wiper member;

drive means for moving the wiper holder between a first position where the wiper member linearly projects into the moving plane and a second position where the wiper member linearly retracts out of the moving plane and contacts the ink absorber member after wiping; and an arm member having the ink absorber member thereon, the arm member being moved toward a plane of the wiper member, opposite to a recording place of the ink jet head with respect to the recording medium, corresponding to movement of the wiper holder driven by the drive means.

11. An ink jet recording apparatus according to claim 10, wherein the wiper member positioned at the first position wipes the nozzle plane of the ink jet head while the ink jet head moves along the moving plane.

12. An ink jet recording apparatus according to claim 11, wherein the plane of the wiper member, opposite to the recording place of the ink jet head with respect to the recording medium, comes into contact with the nozzle plane of the ink jet head, and the ink absorbing member comes near the wiper member from a side opposite to the recording place.

13. An ink jet recording apparatus comprising:

an ink jet head that ejects ink droplets onto a recording medium, the ink jet head being moved and having a moving plane defined by a nozzle plane while moving;

a wiper member that wipes the nozzle plane of the ink jet head so as to remove surplus ink on the nozzle plane and recover ink jetting condition of the ink jet head;

an ink absorber member that absorbs the ink adhered to the wiper member;

a movable wiper holder that holds the wiper member; and drive means for moving the wiper holder between a first position where the wiper member projects in the moving plane and a second position where the wiper member contacts the ink absorber member after wiping;

wherein the wiper member positioned at the first position wipes the nozzle plane of the ink jet head while the ink jet head moves along the moving plane, and a plane of the wiper member, opposite to a recording place of the ink jet head with respect to the recording medium, comes into contact with the nozzle plane of the ink jet head, and the ink absorber member comes near the wiper member from a side opposite to the recording place.

14. An ink jet recording apparatus according to claim 13, wherein the wiper member is normally positioned at the second position and moves to the first position when the ink jet head moves from a position opposite to the recording place with respect to the wiper member toward the recording place.

15. An ink jet recording apparatus according to claim 13, wherein the drive means moves the wiper member after wiping from the first position to the second position in a direction opposite to the recording place.

16. An ink jet recording apparatus comprising:

an ink jet head that ejects ink droplets onto a recording medium, the ink jet head being moved and having a moving plane defined by a nozzle plane while moving;

a wiper member that wipes the nozzle plane of the ink jet head so as to remove surplus ink on the nozzle plane and recover ink jetting condition of the ink jet head;

an ink absorber member that absorbs the ink adhered to the wiper member;

a movable wiper holder that holds the wiper member; and drive means for moving the wiper holder between a first position where the wiper member projects in the moving plane and a second position where the wiper member contacts the ink absorber member after wiping;

wherein the wiper member is normally positioned at the second position and a plane thereof opposite to a recording place by the ink jet head with respect to the recording medium is in contact with the ink absorber member, and the wiper member moves to the first position when the ink jet head comes near the wiper member from a position opposite to the recording place with respect to the wiper member toward the recording place.

17. An ink jet recording apparatus according to claim 16, wherein the wiper member positioned at the first position wipes the nozzle plane of the ink jet head while the ink jet head moves along the moving plane.

18. An ink jet recording apparatus according to claim 17, wherein the ink absorber member is disposed at the position opposite to the recording place with respect to the wiper member.

19. An ink jet recording apparatus according to claim 18, wherein the drive means moves the wiper member after wiping from the first position to the second position in a direction opposite to the recording place.

20. An ink jet recording apparatus according to claim 18, wherein the drive means moves the wiper member after wiping from the first position to the second position in a direction substantially perpendicular to the moving plane of the ink jet head.

* * * * *